United States Patent [19]

Vink et al.

[11] 4,237,437

[45] Dec. 2, 1980

[54] DEFLECTION UNIT FOR COLOR TELEVISION DISPLAY TUBES

[75] Inventors: Nicolaas G. Vink; Joris A. M. Nieuwendijk; Werner A. L. Heijnemans, all of Eindhoven, Netherlands

[73] Assignee: U.S. Philips Corporation, New York, N.Y.

[21] Appl. No.: 6,614

[22] Filed: Jan. 26, 1979

[30] Foreign Application Priority Data

Feb. 6, 1978 [NL] Netherlands ..... 7801317

[51] Int. Cl.[3] ..... H01F 3/12

[52] U.S. Cl. ..... 335/211; 335/213

[58] Field of Search ..... 335/210, 211, 212, 213, 335/214

[56] References Cited

U.S. PATENT DOCUMENTS

| | | | |
|---|---|---|---|
| 3,899,761 | 8/1975 | Yamauchi | 335/211 |
| 4,109,220 | 8/1978 | Peart | 335/211 |

*Primary Examiner*—Harold Broome

*Attorney, Agent, or Firm*—Thomas A. Briody; William J. Streeter; Edward W. Goodman

[57] ABSTRACT

A deflection unit for in-line color television display tubes having a line deflection coil and a field deflection coil, the field deflection winding having a slightly pronounced barrel-shaped field deflection field in the middle and on the screen side of the deflection unit and being combined with field-forming means (in particular soft-magnetic segments which are placed between the line and field deflection coils) to generate a pronounced pin-cushion-shaped field on the gun side of the deflection unit. As a result of these measures, the deflection unit couples a coma-free field deflection field with a minimum EW-field distortion.

5 Claims, 11 Drawing Figures

DEFLECTION UNIT FOR COLOR TELEVISION DISPLAY TUBES

BACKGROUND OF THE INVENTION

The invention relates to a deflection unit for a color television display tube, which deflection unit has a field deflection coil, a line deflection coil, and an annular core member of soft-magnetic material enclosing at least the line deflection coil. A line deflection coil is to be understood to mean a combination consisting of two diametrically oppositely arranged line coil positions for deflecting an electron beam in a first (horizontal) direction and a field deflection coil is to be understood to mean a combination consisting of two diametrically oppositely arranged coil portions for deflecting an electron beam in a second (vertical) direction, transverse to the first direction. Each deflection coil portion may be of the saddle type and may consist of electrical conductors wound so as to form a first and a second side strip, a front and a rear end which together define a window, at least the front end being constructed as an upright edge (flange), the line and field deflection coils being surrounded by the annular member of soft magnetic material (the core). Alternatively, the line deflection coil portions may be of the saddle type and the line deflection coil may be surrounded by the core, while the field deflection coil portions are wound toroidally on the core. In the latter case we have a hybrid system.

For displaying (color) television pictures, certain electron-optical requirements are imposed upon the combination of the display tube and the electron beam deflection device.

It holds, for example, that the field displayed on the display screen must be rectangular and undistorted within certain narrow limits. Furthermore, the definition of the picture from the center towards the edge of the screen may decrease only to a restricted non-disturbing extent.

For color display tubes having a shadow mask, there are two additional requirements.

The color selection in a shadow mask tube is obtained by an eccentric arrangement of the three electron guns in such manner that the phosphor dots of a given color are hit only by the electrons of the corresponding beam through the holes in the mask. In order to obtain a color-pure image, the requirement holds that the relative color selection angles of the three beams should remain unvaried upon deflection. This is the landing requirement. When this condition is not satisfied, the possibility of the occurrence of color spots arises.

A second equally important requirement is that the targets of the three electron beams should coincide with each other throughout the screen so that the pictures in the three primary colors fully converge. This is the convergence requirement. When this requirement is not satisfied, disturbing color edges at brightness and color transitions occur.

Of great importance for the further development of color television display systems was the introduction of the "in-line" display tube in which the electron guns are arranged in one plane. The basic idea of this design is that it is then possible with this arrangement to obtain automatic convergence (self-convergence) throughout the display screen while using strongly astigmatic deflection fields. A correct astigmatism level of the field deflection coil will be described hereinafter.

For a good astigmatism level of the field deflection coil, the field deflection field should show a barrel-shaped variation in the middle and on the screen side of the deflection unit. When this variation is realized with a set of normal (straight wound) toroidal field deflection coil portions or with a set of normal saddle-shaped field deflection coil portions (having a constant average window opening), the generated magnetic field necessarily has a barrel-shaped variation everywhere, so also on the gun side. "Straight wound" is to be understood to mean herein that the turns constituting the coil portions are located in planes passing through the longitudinal axis of the core. Since it is usual to position the three electron guns in the sequence red, green, blue, this has for its result that upon deflection, the green beam lags with respect to the average of the red beam and the blue beam. This error of the field deflection coil is termed coma.

It is possible to mitigate coma by winding the field deflection coil portions in a special manner: for this purpose, a toroidal field deflection coil portion should be wound "obliquely", and a saddle-shaped field deflection coil portion should be wound so that the average window opening varies in the axial direction. However, the disadvantage of this solution is that, apart from the complicated winding process, it introduces a substantial East-West raster distortion.

SUMMARY OF THE INVENTION

It is the object of the invention to provide a deflection unit of the kind mentioned in the preamble which couples a coma-free field deflection field with an EW frame distortion which is as small as possible.

For that purpose the deflection unit according to the invention is characterized in that the field deflection coil has been wound so that, when the deflection unit is mounted on a display tube having a neck-portion, a display screen and an intermediately located cup-shaped outer surface, upon energization, it produces a little pronounced barrel-shaped field deflection field in the middle and on the screen side of the deflection unit, and is combined with flux altering means to produce a pronounced pin cushion-shaped field deflection field on the neck side of the deflection unit. As will be explained in detail hereinafter, the end in view: a field deflection field which couples coma correction with a minimum EW-raster distortion, is achieved with a field variation as described above.

A preferred embodiment of the deflection unit in accordance with the invention which is very easy to realize is characterized in that the flux altering means comprise two soft-magnetic elements which are provided diametrically opposite to each other outside the line deflection coil, mainly transverse to the magnetic field of the field deflection coil, on the neck side of the deflection unit. It is essential that the soft-magnetic elements, viewed from the longitudinal axis of the deflection unit, should be situated outside the line deflection coil portions so that they do not influence, or hardly influence, the line deflection field. In fact, the soft-magnetic elements in this manner operate as a kind of extension of the core surrounding the line deflection coil.

The construction of the elements as circularly bent segments of soft-magnetic sheet material makes it easy to assemble them—in particular in a deflection unit with so-called shell-type coils—on the plastic coil support (the so-called cap), for example, by adhering them to the cap before the field coil portions are provided

DESCRIPTION OF THE DRAWINGS

The invention which also relates to the combination of a deflection unit as described hereinbefore having a color display tube will now be described in greater detail, by way of example, with reference to the accompanying drawings, in which.

DESCRIPTION OF THE PREFERRED EMBODIMENTS

Figure 1:
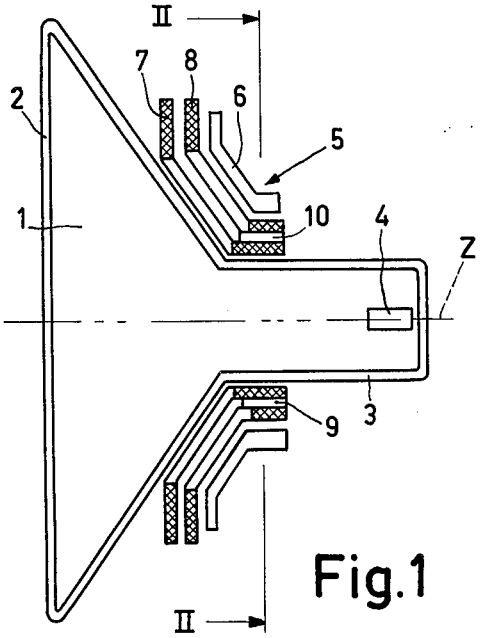
FIG. 1 is a diagrammatic longitudinal sectional view of a color television display tube having a deflection unit according to the invention.
Figure 2:
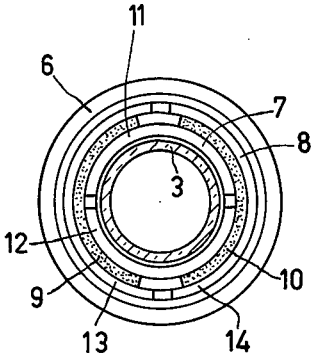
FIG. 2 is a diagrammatic elevation of a cross-sectional view of the color display tube shown in FIG. 1 taken on the line II—II.

FIGS. 1 and 2 show a color display tube 1 having a display screen 2, a neck 3 and an electron gun configuration 4. An electron beam deflection unit 5 is mounted on the display tube 1. The deflection unit 5 is mounted on the display tube 1. The deflection unit 5 comprises an annular member 6 of magnetically permeable material which encloses a line deflection coil 7 and a field deflection coil 8. The deflection coils 7 and 8 in the present case consist of a set of coil portions 11, 12 and 13, 14, respectively, of the so-called shell-type, that is to say that their rear ends (the ends situated nearest to the neck 3 of the display tube 1) extend parallel to the longitudinal axis z of the display tube 1. However, the invention is not restricted to the use of this type of (saddle) coils.

Figure 3:
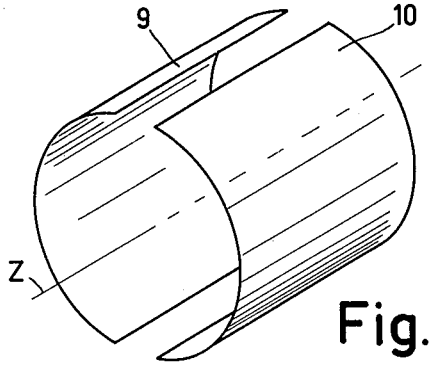
FIG. 3 is a perspective view of the flux altering elements shown in FIGS. 1 and 2.
Figure 4:
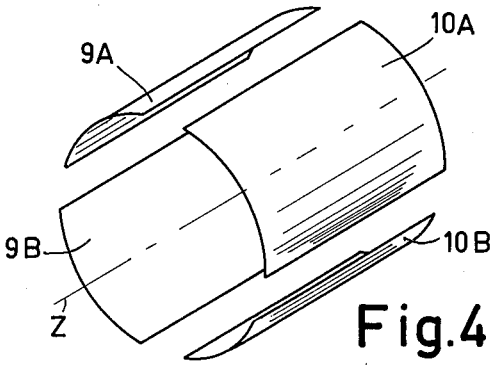
FIG. 4 is an elevation equal to that of FIG. 3 showing a different construction.

Flux altering segments 9 and 10 are arranged between the deflection coils 7 and 8 in such manner that segment 9 is situated below the field deflection coil portion 13 and segment 10 is situated below the field deflection coil portion 14. As a result of this, the segments 9 and 10 extend mainly transverse to the field deflection field. While FIG. 3 shows segments 9 and 10 each consisting of one piece (in which a dimension in the z-direction is, for example, 20 millimeters for a deflection unit for an in-line 110° display tube having a 26 inch display screen in a so-called thick-neck construction), the division of the segments 9 and 10 into an equal number of separate sections, for example 9A, 9B and 10A, 10B (FIG. 4), presents the additional advantage that the (2nd order) effect of line coma can be reduced. The segments 9A, 9B and 10A, 10B have the same shape and are positioned symmetrically. They may be manufactured from any soft-magnetic material having a permeability $\mu > 100$.

The effect of the segments 9, 10 will be explained in detail hereinafter.

Figure 5:
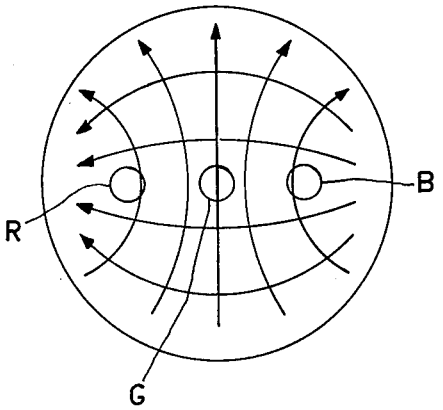
FIG. 5 shows diagrammatically the deflection fields which are generated in a conventional in-line color display tube on the screen side of the deflection unit.

When an in-line color display tube is combined with a deflection unit of the astigmatic type which has a field distrubution in which, as shown in FIG. 5, the field deflection field is barrel-shaped and the line deflection field is pin cushion-shaped, automatic convergence is possible in principle.

As described hereinbefore, in order to obtain a good astigmatism level of the field deflection coil, the field deflection field should have a barrel-shaped variation in the middle and on the screen side of the deflection unit. When straight-wound toroidal field deflection coil portions are used, this means necessarily that the magnetic field has a barrel-shaped variation everywhere, hence also on the gun side. As a result of this, in this case, upon deflection, the green beam will lag with respect to the average of the red beam (R) and the blue beam (B) (FIG. 5). This deflection error is termed field coma.

Figure 6:
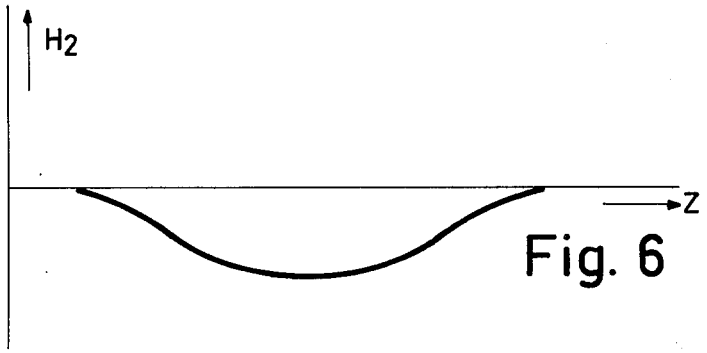
FIGS. 6 and 7 are graphic representations of the value of the parameter $H_2$ along the z-axis of display tubes having conventional deflection units.

FIG. 6 shows a graph representing the variation along the z-axis of the parameter $H_2$ known from the technical literature for a straight-wound toroidal field deflection coil. Where $H_2$ is positive the field line configuration in a plane perpendicular to the z-axis is pin cushion-shaped and where $H_2$ is negative it is barrel-shaped. For the description and the measurement of $H_2$ reference is made to the article by R. Vonk in Philips Technical Review 32, 1971, Nos. 3/4, pp. 61–72. For a coma-free magnetic field, the value of $H_2$ integrated in the axial direction must be small. For straight-wound toroidal field deflection coil portions, however, this value is considerable.

The field defects, as they are generated by a deflection unit are determined in particular by the shape of the deflecting fields on the screen side of the unit.

A barrel-shaped variation of the magnetic field of the field deflection coil in this area stimulates a pin cushion-shaped EW-field distortion. In the case of straight-wound toroidal field deflection coil portions, the extent of barrel-shape of the field is comparatively low so that the resulting EW pin cushion distortion turns out to be comparatively low (8% is characteristic).

Figure 7:
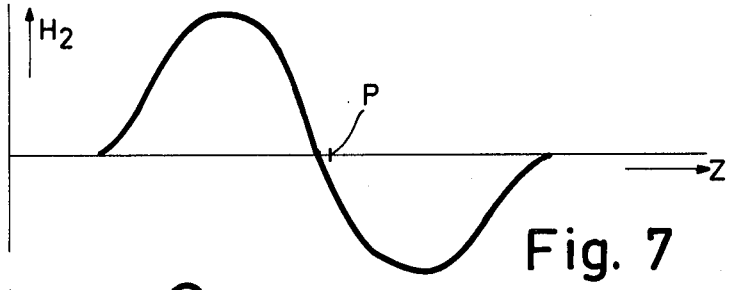

A possibility of correction of the field coma is formed by "obliquely" winding the toroidal field coils. Herewith it can be achieved that the field on the gun side of the field deflection coil becomes pin cushion-shaped so that the coma is precorrected as it were for the coma influence of the barrel-shaped field farther on, on the screen side of the deflection unit. The variation of the field parameter $H_2$ will then be as indicated in FIG. 7. The zero passage of $H_2$ lies near the deflection center P. The integrated value is now small. In order to arrive at a good astigmatism level, the field deflection field on the screen side of the unit must be much more strongly barrel-shaped when obliquely wound coil portions are used than when straight-wound field coil portions are used, so that said coils have a strong pin cushion-shaped EW-raster distortion (in this case 14% is characteristic).

As regards the field shapes which can be generated and the results with respect to astigmatism, coma and field defects, roughly the same conclusions hold for field deflection coils with coil portions of the saddle-type as described for the toroidal field deflection coils.

The form of the generated magnetic field for a given axial position is determined by the distribution of the conductor turns in the more axially varying parts of the coil portions at the level of the relevant axial position. A measure of this distribution is the "average window opening". This is defined as the angle $\theta$ with respect to the axis of the deflection unit. A deflection coil portion having a constant average window opening then generates an axial variation of the parameter $H_2$ analogous to that of a straight-wound toroidal coil portion. By causing the average window opening to vary in the axial direction, the same variation of $H_2$ can roughly be obtained in a saddle coil as in the "obliquely" wound toroidal field deflection coil portions. This means that for a field deflection coil having deflection coil portions of the saddle type with varying window openings, it will also hold that since the field coil is made coma-free a larger EW-raster distortion will be the result than when coma is permitted.

Figure 8:
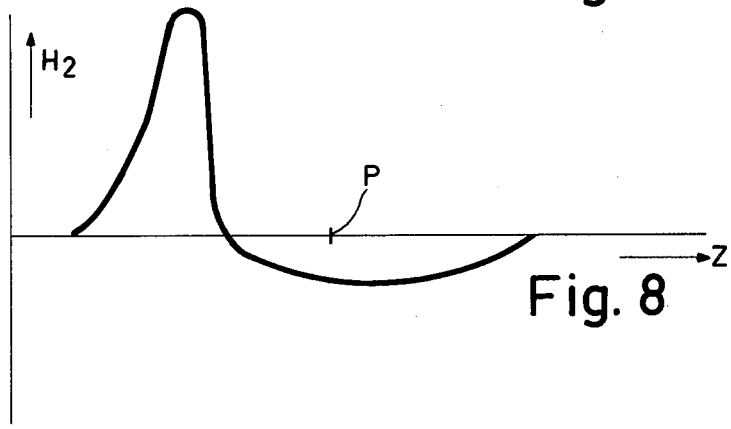
FIG. 8 shows diagrammatically the value of the parameter $H_2$ along the z-axis of a display tube having a deflection unit according to the invention.

The invention is based on the consideration that in order to obtain a combination of a coma-free field deflection field and an optimum EW-field distortion, a variation of the parameter $H_2$ is required as is shown in FIG. 8. In this case the zero point of $H_2$ is situated considerably before the field deflection center P, on the gun side of the deflection unit. The favorable effect of this shape of $H_2$-variation can be explained as follows. The integral of $H_2$ provides a small value so that the generated coma can be negligibly small. The field deflection field being barrel-shaped in the middle and on the screen side of the deflection unit, the astigmatism level of the field deflection coil may turn into a good value with nevertheless a small barrel-shape of the field deflection field on the screen side. This promotes a smaller EW-pin-cushion-shaped distortion.

Figure 9:
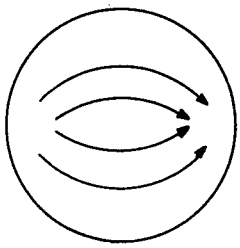
FIGS. 9, 10 and 11 show the field deflection fields generated by the deflection unit according to the invention.
Figure 10:
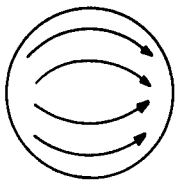
Figure 11:
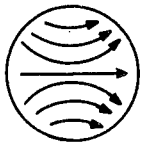

A preferred embodiment of the deflection unit according to the invention involves that, for the field deflection coil portions, a conductor distribution is chosen which generates a magnetic field having a weak barrel-shape in the middle (FIG. 10) and on the screen side (FIG. 9). The strong pin cushion shape over a small area on the gun side (FIG. 11) is generated by using segments of thin, soft-magnetic material 9, 10 as flux altering elements in behalf of the field deflection field. A simple embodiment consists of two semicircular sheets placed diametrically with respect to each other in the field deflection fields and separated by two gaps. Parameters influencing the effect of these field-forming elements are the axial length and the width of the gaps. Known measures may be taken to suppress eddy currents, if any (choice of high-ohmic material, laminated sheet).

Essential for a good operation is that the segments, viewed from the axis of the deflection unit, must be situated outside the line deflection coil so as to not, or only slightly, influence the line deflection field. In fact the segments then operate as an extension of the yoke ring for the line coil. If on the contrary the segments, viewed from the axis, were to be situated within the line coil, a strong, generally undesired, influence of the line deflection field would be the result.

What is claimed is:

1. A deflection unit for a color television display tube, said deflection unit comprising a core, a vertical deflection coil and a horizontal deflection coil, said vertical deflection coil having a winding distribution for producing, when said deflection unit is mounted on a display tube having a neck portion, a display screen and a funnel-shaped central portion therebetween, a weakly barrel-shaped vertical deflection field at the central portion and the screen-side portion of the deflection unit, and a pin cushion-shaped vertical deflection field at the neck-side portion of said deflection unit, wherein said deflection unit further comprises flux altering means associated with said vertical deflection coil and disposed at the neck-side portion of the vertical deflection coil for achieving a sharp pin cushion-shaped vertical deflection field at the neck-side portion of the deflection unit for correcting coma distortion.

2. A deflection unit as claimed in claim 1, wherein the flux altering means comprise two soft-magnetic elements which are provided diametrically opposite to each other outside the horizontal deflection coil, mainly transverse to the magnetic field of the vertical deflection coil, on the neck side of the deflection unit.

3. A deflection unit as claimed in claim 2, wherein the two soft-magnetic elements are each formed by a circular, curved segment, which segments are provided at a previously determined distance from each other.

4. A deflection unit as claimed in claim 2, wherein the two soft-magnetic elements are each formed by at least two circular, curved segments which are provided at previously determined distances from each other.

5. The combination of a deflection unit as claimed in claim 1, 2, 3 or 4 with a color television display tube having a neck-shaped portion, a display screen and an intermediate cup-shaped outer surface, wherein the horizontal deflection coil comprises two diametrically oppositely located horizontal coil portions each formed from electrical conductors which are wound so as to form a first and a second side strip, a front and a rear end which together define a window, at least the front end being bent away from the longitudinal axis of the display tube and being situated more adjacent to the display screen than the rear end, and the flux altering means are positioned so that they influence the vertical deflection field but do not appreciably affect the horizontal deflection field.

* * * * *